United States Patent [19]

Vix

[11] 4,019,269

[45] Apr. 26, 1977

[54] GRAPHIC EXHIBITOR TROPHY

[76] Inventor: Lloyd J. Vix, R.R. 1, Houston, Minn. 55943

[22] Filed: Oct. 24, 1975

[21] Appl. No.: 625,444

[52] U.S. Cl. ..... 40/19; 40/152; 40/306

[51] Int. Cl.[2] ..... G09F 3/20

[58] Field of Search ..... 40/19, 152, 152.1, 152.2, 40/156, 155, 158 R, 106.1, 63 R, 126 R, 306, 310, 10 R, 16.2, 16.4

[56] References Cited

UNITED STATES PATENTS

| | | | |
|---|---|---|---|
| 719,597 | 2/1903 | Lee | 40/19 |
| 1,032,282 | 7/1912 | Hay | 40/19 X |
| 1,508,523 | 9/1924 | Naterman | 40/19 |
| 1,546,992 | 7/1925 | Oppman | 40/19 |
| 2,235,870 | 3/1941 | Dedmon | 40/19 |
| 3,293,787 | 12/1966 | McMahon | 40/19 X |
| 3,365,820 | 1/1968 | Connell | 40/68 X |
| 3,374,911 | 3/1968 | White | 40/310 |

FOREIGN PATENTS OR APPLICATIONS

| | | | |
|---|---|---|---|
| 496,472 | 4/1929 | Germany | 40/19 |
| 175,477 | 2/1922 | United Kingdom | 40/19 |

*Primary Examiner*—John F. Pitrelli
*Attorney, Agent, or Firm*—Henry C. Kovar

[57] ABSTRACT

An exhibitor for displaying a graphic award in a trophy is disclosed having a transparent tubular window, a window liner which is removable from inside of the window for placing a message thereon, and a removable end cap for normally retaining the liner inside the window.

7 Claims, 4 Drawing Figures

GRAPHIC EXHIBITOR TROPHY

BACKGROUND OF THE INVENTION

1. Field of the Invention

This invention relates to a graphic award exhibitor and more specifically to a member for an award trophy, for containing and displaying a graphic award as part of the trophy.

2. Prior Art

Trophies have been provided previously that have metal or plastic plates secured to a visible location of the trophy; the plate carries an engraved message which usually explains the circumstances of the award and the relative position of the award. As is well known, this engraving is very expensive; requires a considerable time to apply and therefore requires trophies be ordered a substantial time period in advance of actual need. Typically, trophies of this type are awarded in different relative sizes indicating a position of award; for example the largest trophy goes to fist place and the smallest to the last place receiving awards. As a consequence of this previous practice, a considerable, expensive inventory of components is required to be kept on hand, or else different sized components must be individually made to order.

Another example of the prior art is a simple picture frame, which is well known to be inexpensive, but is also relatively undersirable by most award recipients as compared to a trophy.

There is a great segment of trophy market for an extremely economical trophy, a specific example of which is the child participant or competitor who is too old or wise to be appeased or inspired by a ribbon but does not yet expect or demand an expensive custom engraved trophy. The prior art does not really fulfill this need.

Accordingly, it is an object of the present invention to provide a component for economical construction of an award trophy.

Another object of the present invention is to provide an economical trophy component for displaying a graphic award.

A further object of the present invention is to provide an economical structure for individualizing a trophy.

Yet another object of the present invention is to provide a standard trophy which is customizable to a specific use very economically.

SUMMARY OF THE PRESENT INVENTION

In accordance with this invention, a graphic award exhibitor for a display trophy has a transparent tubular display window, a flexible initially flat liner within the window, the liner being removable, and suitable for having an award message applied thereto, and a snap-fitted end cap on the window, the cap being removable for access to the liner.

Many other advantages, features and additional objects of the present invention will become mainfest to those versed in the art upon making reference to the detailed description and the accompanying drawings in which a preferred structural embodiment incorporatig the principles of the present invention is shown by way of example.

Figure 1:
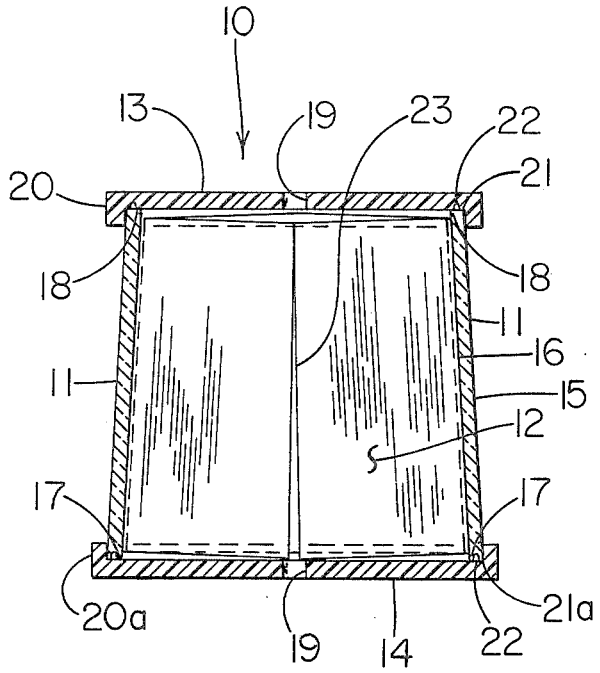
FIG. 1 is an elevational view, in partial section, of an award exhibitor for a trophy, provided in the present invention.

AS SHOWN ON THE DRAWINGS:

The principles of the present invention are particularly useful when embodied in a graphic award exhibitor, such as shown in FIG. 1, and generally indicated by the numberal 10. The exhibitor 10 includes a window 11, a window liner 12, an end cap 13 closing one end of window 11.

The window 11 is a transparent tubular section of a material such as glass or acrylic and has an outer face 15 which is exposed to the sight of the viewer, and an inner surface 16 against which the liner 12 bears as will be explained. The window 11 has a bottom edge 17 which is, as shown, as annular surface extending around the bottom end of the tubular member forming the window 11. Attached to the lower end of window 11 is an opaque end cap 14 which closes and covers the bottom of window 11 and serves to retain and support liner 12 within the window 11. The window 11 has an upper edge 18 which is as shown, an annular suface extending around the upper end of the tubular member forming window 11. Attached to the upper end of window 11 is an opaque end cap 13 which covers the top of the window 11 and serves to retain liner 12 within the window 11. Each of the end caps 13, 14 has a centrally located aperture 19, through which a tie rod (not shown) may be installed for positive retention of the end caps 13, 14 to the window 11.

The liner 12 is intended to be a graphic award and for application of graphics to the liner 12, it is required that the liner 12 be removable from the window 11. In the following explanation, end cap 13 will be the removable end cap. End cap 13 has a rim 20 which is sized with respect to the upper end of window 11 to form between the end cap 13 and window 11 a light-press fit or what amounts to a snapfit. In the preferred embodiment as shown, the rim 20 is an annular flange about the periphery of the end cap 13 which extends around the outside of the upper end of window 11 in the form of a collar. The inside surface of the rim is slightly smaller than the relative size of the window 11 forming an interference therebetween. The end cap 13 also has a seal surface 21 which, in the embodiment shown, bears against the upper edge 18 of the window 11. It will be appreciated that with this structure, the end cap 13 can be manually snapped onto the window 11, and the window 11 and end cap 13 will retain themselves together; the end cap 13 is also manually removable by merely applying a force against the rim 20 and snapping the end cap 13 off from the window 11. When the window is snapped off, the liner 12 is then accessible.

The other or bottom end cap 14 may be of similar construction, with respect to the lower end of the window 11, and have a rim **20*a* and a seal surface 21*a* essentially identical to those of end cap 13 as previously explained. Alternatively, end cap 14 could be permanently fastened to the window 11 by means of adhesives or the like or could even be molded as an integral part of the window 11 provided that the other end of the window 11** has a removable end cap.

The window 11 may be fabricated by a variety of processes, for example extrusion, centrifugal casting, injection molding or by any of the glass processes. It has been found that the most economical and best appearing window 11 is made by injection molding, but as a consequence of injection molding, the window 11 must have a taper in order to be removable from a mold without scratching. The window 11 shown in FIG. 1 is tapered and as will be apparent the end caps 13, 14 must be fittable to two different sized ends of window 11. In the embodiment shown, the end caps 13, 14 are provided with means for being fitted to different sized ends of the window 11. In the configuration shown each end cap 13, 14 has a rim 20, 20*a* which is sized to fit a particular end of window 11. For ease of assembly, both ends of window 11, and each end cap 13, 14 have coded keys 22 which may be male to female for one of the end caps to thewidow 11 and the window to male for the other of the end caps to the opposite end of the window.

The liner 12 is an initially flat sheet of material, which the most economical and ready available configuration of is a regular square sided and parallel edged rectangle. The liner 12 is formable to the inner contour of the window 11 and is sized to completely cover the viewable inner suface 16 of the window 11 with opposite edges of the liner 12 abutting against each other and forming a seam 23 which is parallel to the axis of the tubular window 11. As a result of the tapered shape of the window 11, a rectangular liner, which is the most economical configuration and also has the advantage of being reversible within the window 11 so that either side of liner 11 can be used as a visible surface, does not perfectly follow the interior edges of the window 11. As is seen in FIG. 1, the liner 12 edge tend to climb angularly inward from both the larger end and the smaller end of the window. The gaps caused by the climbing of the liner 12 edges are hidden from view by the opague rims 20, 20*a* which obstruct view therethough. If the rim 20*a* is molded integrally with the window 11, as has previously been explained possible, there is an irregular surface which extends essentially the same height as the illustrated rim 20*a*, the irregular surface being frosted or of some other well known surface configuration which obstructs vision for the purpose of concealing the liner 12 gap deviation. The illustrated exhibitor 10 is of a cylindrical shape and the liner 12 is formed of flexible initially flat sheet material and does not have any score marks which would show through the window 11 or make application of a wirtten message difficult.

One of the important features of the present invention is the provision of an exhibitor 10 which can be easily arranged to a one of a plurality of award positions, for example first, second, third and fourth places. As has previously been described, the end caps 13, 14 are opaque for the purpose of obstructing view into the ends of the exhibitor 11. The end caps 13, 14 may be a selected one of a plurality of colors, for example blue from the group of blue, red and white to indicate a relative first place. This color can either be molded by the exhibitor maker or spray painted by the award given. A further, extremely economical means for providing colorful indication of relative position of award is providing a liner 12 having a first color on one surface and a second color on the opposite surface. As previously explained the liner 12 is visible within the window 11. Another means for extemely economical, quick and easy indication of relative award position is clearly shown in FIG. 2 in which an exhibitor 10 is shown with the end cap 13 removed, and four liners 12, 12*a*, 12*a*, 12*b*, 12*c* being wrapped one inside of another. Each of these liners is of a different one color from a predetermined plurality of colors, for example gold, silver, bronze and copper. The plurality of liners 12, 12*a*, 12*b* and 12*c* are provided in the exhibitor 10 by the manufacturer. The award giver then uses the desired color and discards the rest. These liners all each have at least one surface upon which an award giver can write or type a personalized message, an example of which would be "Congratulations John, from your Coach Mr. Jones". A most economical and effective liner is formed by paper having a thickness in the range of twelve to fifteen points.

Figure 3:
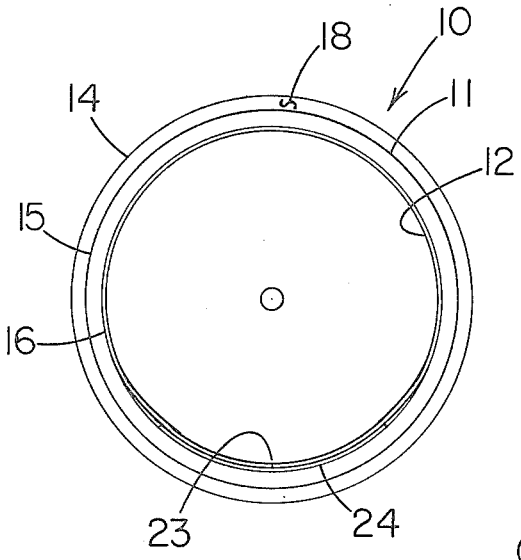
FIG. 3 is a top view of the structure of FIG. 1, shown in a different configuration than in FIG. 2.

Another important feature of the present invention is well shown in FIG. 3 in which the liner 12 is shown retaining a photograph 24 against the inner surface 16 of the window 11. The liner 12 is sized to retain and press the photograph 24 against the inner surface 16, and the seam 23 of the liner 12 is intended to go behind and be hidden by the photograph 24 as clearly shown. The photograph 24 may alternatively be any kind of custom graphic award print provided by an individual award giver and may be similar in uniqueness to a photograph.

Figure 4:
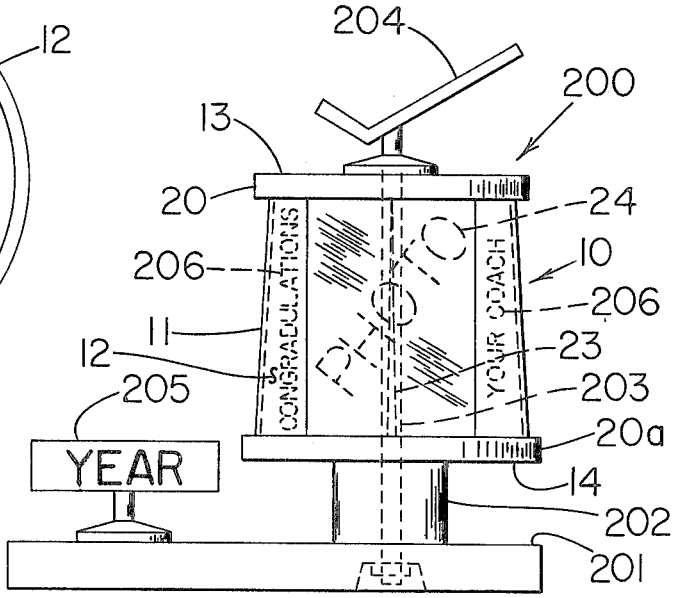
FIG. 4 is an elevational view of a trophy having the structure of FIG. 1.

A completed trophy, generally indicated by the numeral 200, is shown in FIG. 4. The trophy, 200 includes a base 201, a pedestal 202, an exhibitor 10 placed atop this pedestal, and a tie rod 203 which is compressibly fastening the base 201, pedestal 202 and exhibitor 10 together; inasmuch as the exhibitor is compressibly fastened, the end caps 13, 14 are compressed against the window 11 and the seal surfaces 21, 21*a* form a seal against window edges 17, 18 for protecting the contents of the exhibitor 10. Atop the exhibitor may be some type of event indicator 204 and the trophy 200 may also have a year indicator 205 mounted to the base 201. In the embodiment shown, the exhibitor 10 is cylindrical and may be turned to face any direction on the trophy 200. Within the exhibitor 10 is a photograph, or printed separate award, 24 which is held against the window 11 by the liner 12. The photograph or award print 24 covers the seam 23 between the ends of the liner 12. On the liner 12, there may be a personalized message 206, for example "CONGRATULATIONS! YOUR COACH", applied by handwritten pen or typewritten, as is shown in dotted line.

Figure 2:
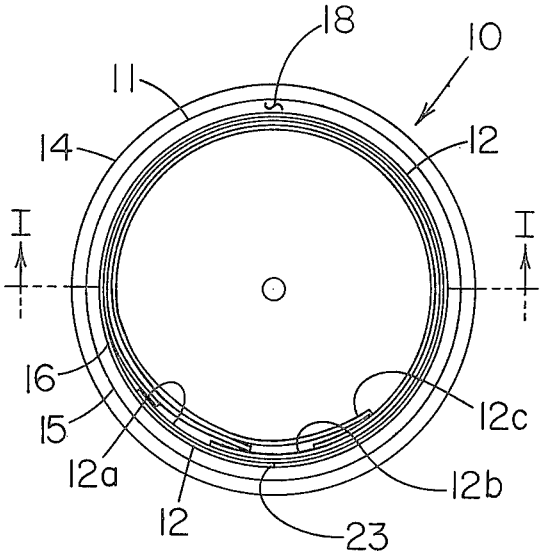
FIG. 2 is a top view of the structure of FIG. 1; the lines 1–11 indicating the partial sectional view shown in FIG. 1.

Operative use of the present invention involves many people and gives each of them an advantage. For example the manufacturer provides tooling for the window 11, end caps 13, 14 and liner 12. These parts are made in a broad spectrum of colors indicative of relative position and event. The manufacturer can assemble and box the exhibitor 10 with a single liner 12, with a liner 12 having separate colors on each side, or with a plurality of liners 12 as shown in FIG. 2. When packaged in boxes with cardboard dividers, the exhibitors 10 may all be of one configuration and the rims 20, 20*a* protect the transparent window 11 from being scratched.

The trophy maker merely has to maintain an inventory of exhibitors 10 of the same configuration, and upon order can assemble into a trophy 200 and apply whatever event indicator 204 is appropriate. The trophy maker can be extremely competitive in cost for at least three reasons; there is no engraving required, standard parts are used which minimizes capital invested in inventory and delivery time is short.

The awarder of the trophy has been able to obtain an extremely economical trophy. Rather than buying expensive engraving, which is almost always limited in content for economic reasons, the awarder can apply his own message, can apply a photo of himself with the trophy receiver, can apply his signature; all of these applications enable a trophy giver to project his person into the trophy receiver's future and memory.

The trophy awarder may unfasten the rod 203, snap the end cap 13 from the window 11 and remove the liner 12. The liner 12 may then be fattened on a writing surface and a message manually applied. The awarder may select the appropriate color of liner 12 and discard the undesired liners. If a photograph or graphic print 24 is to be used it would be inserted into the window 11, the liner 12 is then installed with the seam 23 behind the print or photograph 24 with the message 206 facing outward and visible through the window 11. The end cap 13 is then resnapfitted to the window 11 and the tie rod 203 reinstalled and tightened whereupon the end caps 13, 14 seal to the window 11. The trophy 200 is then completed and ready for presentation.

Although various minor modifications may be suggested by those versed in the art, it should be understood that I wish to embody within the scope of the patent warrented hereon, all such embodiments as reasonably and properly come within the scope of my contribution to the art.

I claim as my invention:

1. A graphic award exhibitor for a displayable trophy, comprising in combination:

a. a transparent rigid tubular display window having an exposed outer face, an inner window surface having a tapered contour against which graphic award material may be presented, a closed end, and, an openable end for insertion and removal of graphic material in the window;

b. a flexible initially rectangular and flat window liner formable to the contour of the window tapered inner surface and sized to completely cover the inner surface, the liner being inserted within the window and pressed against the inner surface by the stress within the liner when formed to the contour of and placed within the window inner surface, the liner being removable from the window and returnable to the flat form, having a surface upon which a graphic message may be written, being re-formable and re-insertable in the window after application of the graphic message with the graphic message facing against the window inner surface, being visible through the window, and forming at least part of a graphic award, the liner having initially parallel edges which climb angularly around the tapered inside window contour and inward from each window end;

c. a peripheral rim wit an opaque annular flange about the closed end of the window, the flange having height on the window greater than the angular climb of the lines from the closed window end, for visually concealing the angular liner climb on the closed end; and d. A removable opaque end cap having a peripheral rim with an annular flange snap-fitted to and about the open end of the window and retaining the cap to the window, the cap forming a retainer for retention of the liner within the window and being manually removable from the window by disengagement of the rim flange, for access to, removal of and re-insertion of the liner, the end cap being re-snap-fittable to the window for retention of a re-inserted liner, and the flange having a height on the window greater than the angular climb of the liner from the openable window end, for visually concealing the angular liner climb on the closed end.

2. An award exhibitor according to claim 1, in which the liner is sized to retain and press a photograph against the inner surface of the window, the photograph being insertable between a liner edge seam and the tapered inner window surface for covering the liner seam.

3. A graphic award exhibitor for a displayable trophy, comprising in combination:

a. a transparent rigid tapered tubular display window having an exposed tapered outer face, a tapered inner window surface having a contour against which graphic award material may be presented, and a pair of openable ends for insertion and removal of graphic material in the window;

b. a flexible initially flat window liner formable to the contour of the tapered window inner surface and sized to completely cover the inner surface, the liner being inserted within the window and pressed against the inner surface by the stress within the liner when formed to the contour of and placed within the window inner surface, the liner being removable from the window and returnable to the flat form, having a surface upon which a graphic message may be written, being re-formable and re-insertable in the window after application of the graphic message with the graphic message facing against the window inner surface and being visible through the window and forming at least part of a graphic award;

c. A pair of removable opaque end caps, each having a rim snapfitted to a respective open end of the window and retaining the cap to the window, the caps forming retainers for retention of the liner within the window and being manually removable from the window by disengagement of a respective rim, for access to, removal of and re-insertion of the liner, the end caps being re-snap-fittable to the window for retention of a re-inserted liner, each end cap and each end of the tube being coded for proper assembly thereof.

4. A graphic award exhibitor for a displayable trophy, comprising:

a. a transparent rigid tubular display window having an exposed outer face, an inner window surface having a contour against which graphic award material may be presented, and a pair of open ends for insertion and removal of graphic material in the window;

b. a pair of removable opaque end caps mounted one each on opposite ends of the window, each end cap closing a respective end of the window and having a peripheral annular rim snap fitted onto and against the outer face of the window, each end cap being retained to the window by the snap fit between the window outer face and the rim and being removable from the window by application of force against the rim for opening an end of the window for insertion of graphic material into the window, each end cap after removal thereof being resnap-fittable to the window after insertion of graphic material in the window for retention of the graphic material inside of the resnap-fitted together window and end caps; and c. means in each end cap for accepting a tie rod extending completely through the exhibitor, for assembly of the snap-fitted together window and end caps into a display trophy, and for positive retention of the end caps to the window when assembled in a trophy

5. A displayable trophy for exhibiting a graphic award comprising in combination:

a. a base;

b. a rigid tapered tubular transparent display window mounted on the base and having an exposed outer-face, an inner window surface and at least one openable end;

c. a flexible initially flat window liner formed to the contour of the inner window surface and sized to completely cover the visible portion of the inner window surface, the liner being inserted within the window and pressed against the inner window surface by the stress within the liner when formed to the window inner contour, the liner being removable from the window, returnable to the initially flat form, having a surface upon which a graphic message may be written, being reformable and re-insertable within the window after application of the graphic message, with the graphic message facing against the inner window surface and being visible through the window and forming at least a part of a graphic award;

d. a removable opaque end cap closing the openable end of the window, retaining the liner within the window, and having a surface for sealing engagement of the cap against the window, and e. means for compressibly securing the end cap, window and base together, the end cap and window forming under compression a seal therebetween for protection of a graphic award placed within the window for exhibition.

6. A trophy according to claim 5, including a separate, graphically printed award portion placed within the window and pressed against the window inner surface by the liner.

7. A trophy according to claim 6, in which the separate graphic print covers a seam formed between two ends of the liner.

* * * * *